US005129239A

United States Patent [19]

Thurman

[11] Patent Number: 5,129,239

[45] Date of Patent: Jul. 14, 1992

[54] ROOF TOP REFRIGERATION EQUIPMENT HOUSING

[76] Inventor: Matt A. Thurman, 10250 Lehman Rd., Orlando, Fla. 32817

[21] Appl. No.: 772,227

[22] Filed: Oct. 7, 1991

[51] Int. Cl.[5] ..... F24F 5/00

[52] U.S. Cl. ..... 62/507; 312/236

[58] Field of Search ..... 62/506, 507, 508; 312/236, 293.2

[56] References Cited

U.S. PATENT DOCUMENTS

| | | | |
|---|---|---|---|
| 3,205,674 | 9/1965 | Arnold | 62/510 X |
| 3,242,686 | 3/1966 | Bowman | 62/510 X |
| 3,735,602 | 5/1973 | Ramsey | 62/507 |
| 4,302,160 | 11/1981 | Hoffmann | 62/507 X |
| 4,415,023 | 11/1983 | Vandervaart | 62/508 X |
| 4,803,848 | 2/1989 | La Brecque | 62/510 X |
| 4,976,114 | 12/1990 | Manning | 62/323.1 |

*Primary Examiner*—Alan Cohan

*Attorney, Agent, or Firm*—William M. Hobby, III

[57] ABSTRACT

A housing for roof top refrigeration equipment has a metal frame supporting at least one compressor unit on a building roof. A pair of end panels and a roof panel are attached to the frame with the roof panel being leak-proof to protect the equipment in the housing. A hinged access panel is attached to the frame and has a closed position and an open position and a pair of panel support members to hold the panel in an open position so that the side panel forms a roof canopy in the open position for sheltering a person working on the equipment in the housing. An electrical box is attached to the exterior of one of the end panels and has an access opening thereinto for rapid access to the power for the refrigeration equipment. An open metal floor, such as a heavy metal screen, is formed onto the frame above the building roof and below the roof panel for supporting the equipment thereon while allowing the drainage of liquids therethrough onto the building roof so that equipment in the housing is protected from the weather and prevents the accumulation of liquids in the housing. The housing also has a blower housing attached to the frame over one side of the housing which blower housing has a plurality of blower openings therein to exhaust air from the housing in a generally horizontal direction.

8 Claims, 2 Drawing Sheets

ROOF TOP REFRIGERATION EQUIPMENT HOUSING

BACKGROUND OF THE INVENTION

The present invention relates to refrigeration equipment and especially to a housing for roof mounted refrigeration equipment for refrigerators in commercial buildings.

In the past, it has been common to mount the compressors, blowers, and the like for refrigeration equipment outdoors and typically on the roof of a building, such as a supermarket. The equipment produces a cooling in the refrigeration and freezer equipment within the building refrigeration units. Supermarkets, which require large amounts of refrigeration, typically have sizable equipment and use plural compressors which may be operated in parallel and mounted in a housing attached to the roof of a building. The equipment on the building roof is typically subjected to the elements since the top of the housings are typically open for upward facing blowers. In addition, oil and water entering the housing will accumulate on the floor which will accelerate the corrosion of components. Repair personnel attempting to repair the roof equipment work in the open sun or in the rain because of the openness of the roof top areas.

The present invention is directed towards an improved housing for refrigeration equipment which allows repair personnel to be shaded as well as protected from the weather upon opening the access panel to the equipment and the equipment has been laid out for ready access from the access panel. In addition, the housing is such that the build-up of liquids is prevented in the housing and rain and weather elements are blocked from readily entering the top of the housing.

Prior art U.S. patents relating to housings for refrigeration equipment may be seen in the Arnold et al. U.S. Pat. No., 3,205,674, for a unitized refrigeration station which has the equipment for a refrigeration station mounted within a small metal building having an entrance door and a blower at one end thereof. In the Vandervaart U.S. Pat. No., 4,415,023, a heat exchanger housing with an air deflecting baffle and hinged door is provided in which one hinged door is opened by the blower swinging the door open. The unit also has a top which is hinged and can be raised and which has serpentine air inlets around the top for the passage of air into the housing and through the heat exchanger coils. In the Bowman et al. U.S. Pat. No., 3,242,686, a unitary machine housing is provided in which the blowers are mounted on the side of the housing behind a series of hinged louvers. Entrance to the housing is from one end through a pair of panel doors.

The Ramsey U.S. Pat. No., 3,735,602, is an air conditioning condensor unit having a housing with an air blower mounted for horizontally blowing the air out one side. Similarly, the Manning U.S. Pat. No., 4,976,114, is an air conditioning unit having an internal combustion engine for mounting on the roof of a building and exhausts air through the side of the housing. The LaBrecque U.S. Pat. No., 4,803,848, shows a typical supermarket cooling system which is CPU controlled using parallel connected equipment.

In contrast, the present housing for refrigeration equipment is designed to improve the life of the equipment by the design of the housing and frame by making for easier access by repair personnel while providing them a protective covering while working on the equipment.

SUMMARY OF THE INVENTION

A housing for roof top refrigeration equipment has a metal frame supporting at least one compressor unit on a building roof. A pair of end panels and a roof panel are attached to the frame with the roof panel being leakproof to protect the equipment in the housing. A hinged access side panel is attached to the frame and has a closed position and an open position and a pair of panel support members to hold the panel in an open position so that the side panel forms a roof canopy in the open position for sheltering a person working on the equipment in the housing. An electrical box is attached to the exterior of one of the end panels and has an access opening thereinto for rapid access to the power for the refrigeration equipment. An open metal floor, which may be a heavy metal screen, is formed onto the frame above the building roof and below the roof panel for supporting the equipment thereon while allowing the drainage of liquids therethrough onto the building roof so that equipment in the housing is protected from the weather and prevents the accumulation of liquids in the housing. The housing also has a blower housing attached to the frame over one side of the housing which blower housing has a plurality of blower openings therein to exhaust air from the housing in a generally horizontal direction.

BRIEF DESCRIPTION OF THE DRAWINGS

Other objects, features, and advantages of the present invention will be apparent from the written description and the drawings in which.

DETAILED DESCRIPTION OF THE EMBODIMENT

Figure 1:
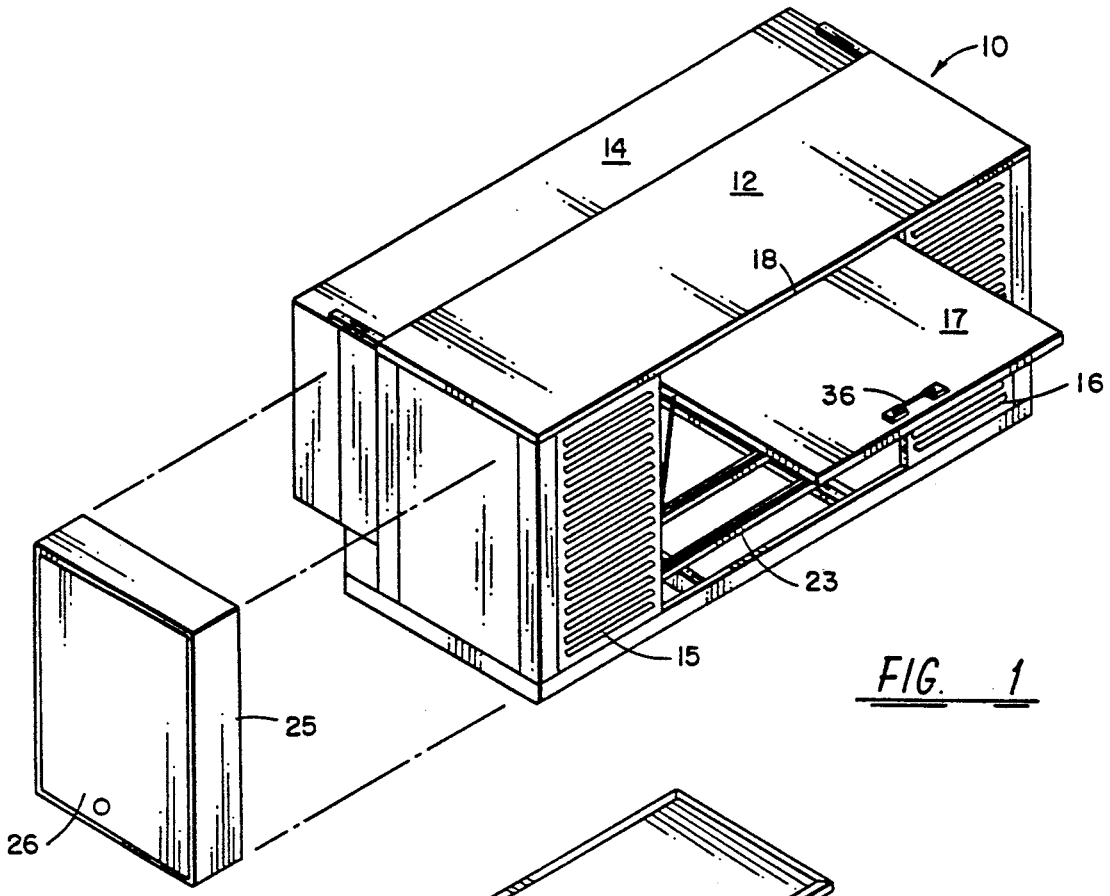
FIG. 1 is an exploded perspective view of a roof top refrigeration equipment housing in accordance with the present invention.
Figure 2:
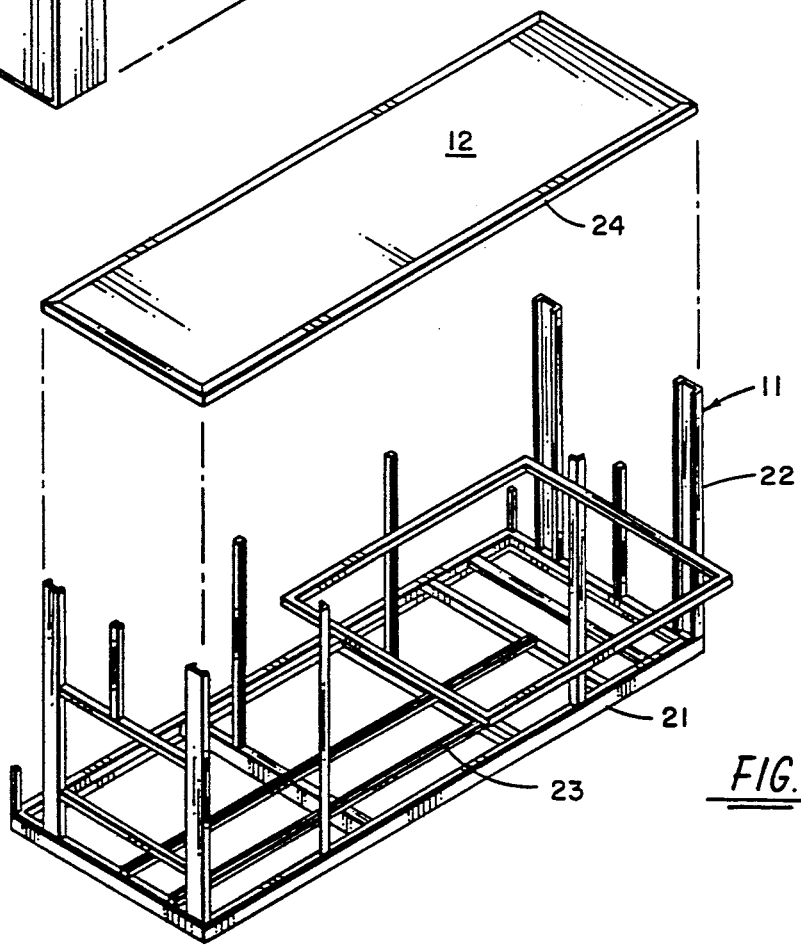
FIG. 2 is an exploded perspective view of the framework with the interconnecting roof panel separated.

Referring to the drawings and especially to FIGS. 1 and 2, a housing 10 is for roof top refrigeration equipment and is mounted on a frame 11, shown in FIG. 2, and having a top panel 12 and a pair of end panels 13. An entire multiple blower unit 14 is mounted to one side of the housing 10 and holds the blower units therein while the opposite side has a pair of louvered panels 15 and 16 and a main access panel 17. Access panel 17 is hinged to the frame along the top edge 18 thereof and is supported in the open position with a pair of pneumatic cylinders 20 hinged between the side edges of the panel 17 and the frame. The frame, as seen in FIG. 2, has a plurality of base frame units 21 welded to a plurality of vertically extending frame units 22 with a plurality of floor and equipment supporting frame members 23 welded into a unitary structure and supported from the top with a frame section 24 in a rectangular shape having the top panel 12 attached thereto. The housing 10, as shown in FIG. 1, has a UL approved electrical panel box 25 attached to the end panel 13 and having a panel access door 26 for rapid access to the electrical power for the refrigeration equipment from the outside of the housing 10.

Figure 3:
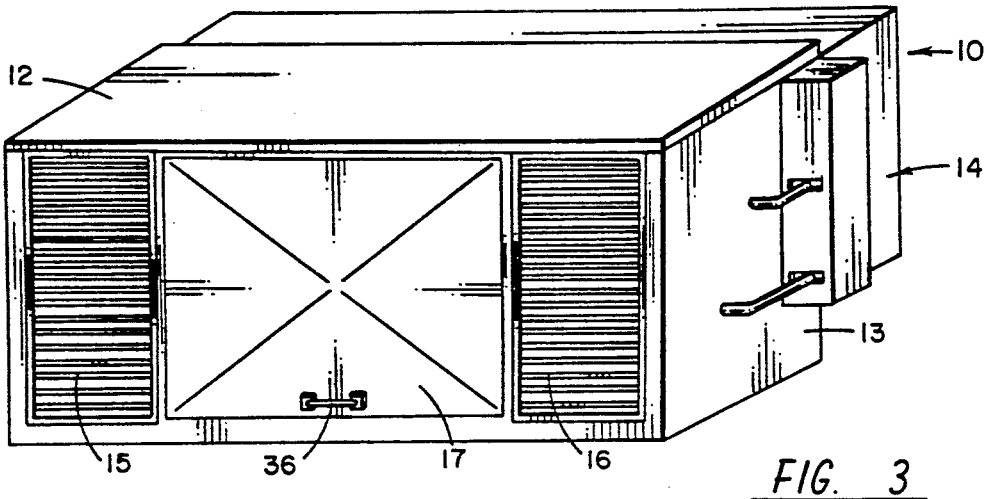
FIG. 3 is a perspective view of the refrigeration housing of the present invention having the access panel closed.
Figure 4:
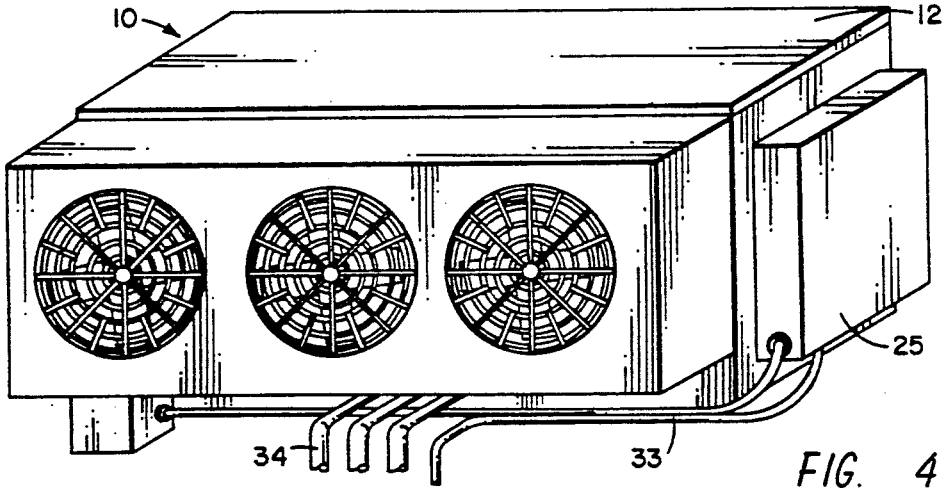
FIG. 4 is a perspective view of the opposite side of the housing of FIG. 3.
Figure 5:
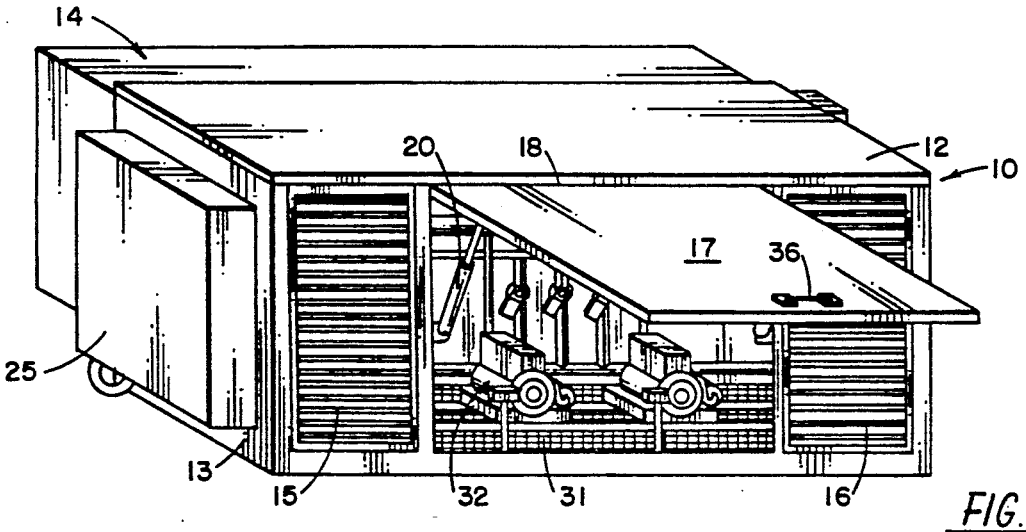
FIG. 5 is a perspective view of the refrigeration housing and equipment of FIGS. 1–4 having the access panel open for access into the housing.

Referring to FIGS. 3-5, the housing 10 has the blower unit 14 and in which FIG. 4 shows the plurality of blower openings 27, each having a grill 28 mounted thereover and blower fans 30 behind the grills 28. The three blowers are illustrated in FIG. 4 which blow air horizontally out of the housing while drawing air through the louvered panels 15 and 16. The roof 12, as seen in all the figures, is a one-piece watertight roof section which prevents rain, snow, or other weather elements from direct access into the housing 10 to reduce the amount of water and other elements that enter the housing. Inside the housing, the framework 11 can be shown to have a heavy steel screen 31 welded to frame members above the roof and the refrigeration equipment 32 can be seen mounted over the screen floor 31. The open floor work 31 allows any water or other liquids that enter the housing to drain therethrough onto the roof rather than accumulating onto the floor and also allows the drainage of any oils or liquids from the equipment to pass therethrough.

FIG. 4 has the electrical connecting lines 30 passing into the panel box 25 where it is then connected through circuit breakers and into the housing to connect the equipment. In addition, a plurality of high pressure refrigerant lines 34 pass into the housing 10.

In FIG. 3, the excess panel 17 has a handle 36 and is shown in a closed position while in FIG. 5 access panel 17 is shown in a raised or open position raised on the hinged portion 18 and supported by a pair of pneumatic cylinders 20. Thus, the access panel can be grasped by the handle 36 and pulled open where it is held in position while a workmen is therebeneath working on the equipment in the housing protected from the rain, sun, or other weather elements while working on roof top equipment where it would otherwise be exposed. In addition, the layout of the housing is such that easy and rapid access is obtained to the equipment. Thus, the electrical panel box 25 can be accessed for controlling the power to the equipment and the access panel 17 can be opened for access to the equipment. In addition, the blower unit housing 14 is separately attached and can be removed for extensive work or replacement.

It should be clear at this point that a housing for a roof top refrigeration equipment has been provided which advantageously provides rapid access to the equipment in the housing while protecting a repairman while working on the equipment. It is also designed to protect the equipment from the weather elements and the accumulation of liquids in the housing. However, the present invention is not to be construed as limited to the forms shown which are to be considered illustrative rather than restrictive.

I claim:

1. A housing for roof top refrigeration equipment comprising:
   - a metal frame supporting at least one compressor unit thereon over a building roof;
   - a pair of end panels and a roof panel attached to said frame, said roof panel being a onepiece leakproof panel;
   - a hinged access side panel attached to said frame and having a closed position and an open position and having at least one panel support member to hold said panel in an open position, said hinged access side panel forming a roof canopy in the open position whereby a person can be sheltered while working in said housing;
   - an electrical box attached to one said panel and having an access opening thereinto; and
   - an open metal floor formed onto said frame above said building roof and below said roof panel for supporting equipment thereon while draining liquids therethrough onto said building roof, whereby equipment in said housing is protected from the weather and prevents the accumulation of liquids in said housing.

2. A housing for roof top refrigeration equipment in accordance with claim 1 including a pair of side louvered panels, one louvered side panel being mounted on each side of said hinged access side panel.

3. A housing for roof top refrigeration equipment in accordance with claim 2 in which the side opposite said access panel side has a plurality of side blower openings therein.

4. A housing for roof top refrigeration equipment in accordance with claim 2 in which said side opposite said access side panel has a blower housing attached to said frame and having a plurality of blower openings therein to exhaust air from said housing in a generally horizontal direction.

5. A housing for roof top refrigeration equipment in accordance with claim 4 in which said frame includes a plurality of steel members welded together.

6. A housing for roof top refrigeration equipment in accordance with claim 5 in which said side access panel support member is a pneumatic cylinder attached between said frame and said panel to support said panel in a raised position.

7. A housing for roof top refrigeration equipment in accordance with claim 6 in which said side access panel support member includes two pneumatic cylinders.

8. A housing for roof top refrigeration equipment in accordance with claim 6 in which said open metal floor is formed of steel reinforcing screen.

* * * * *